US005673970A

United States Patent [19]

Holmquist

[11] Patent Number: 5,673,970

[45] Date of Patent: Oct. 7, 1997

[54] PIVOTING SEAT AND FOOTREST CHAIR

[76] Inventor: Wesley Ross Holmquist, 8005 W. Buckskin, Pocatello, Id. 83201

[21] Appl. No.: 752,654

[22] Filed: Nov. 19, 1996

Related U.S. Application Data

[60] Provisional application No. 60/007,422 Nov. 21, 1995.

[51] Int. Cl.[6] ..... A47C 1/034

[52] U.S. Cl. ..... 297/337; 297/313; 297/423.26; 297/DIG. 10

[58] Field of Search ..... 297/313, 326, 297/337, 423.25, 423.26, DIG. 10

[56] References Cited

U.S. PATENT DOCUMENTS

| | | | |
|---|---|---|---|
| 679,636 | 7/1901 | Parmelee | 297/423.26 X |
| 4,059,305 | 11/1977 | Ammirata | 297/338 |
| 4,067,249 | 1/1978 | Deucher | 297/DIG. 10 X |
| 4,519,649 | 5/1985 | Tanaker et al. | 297/DIG. 10 X |
| 4,637,652 | 1/1987 | Bergenwall | 297/DIG. 10 X |
| 4,778,217 | 10/1988 | Lane | 297/334 |
| 4,929,022 | 5/1990 | Geraci | 297/313 |

FOREIGN PATENT DOCUMENTS

| | | | |
|---|---|---|---|
| 2109676 | 6/1983 | United Kingdom | 237/DIG. 10 |

*Primary Examiner*—Peter R. Brown
*Attorney, Agent, or Firm*—Hopkins Roden Crockett Hansen & Hoopes, PLLC

[57] ABSTRACT

A pivoted seat and footrest chair having a seat and footrest at the top and bottom of a pair of vertical supports such that rotation of the seat forward rotates the footrest back as the person rises out of the chair, allowing easy exiting. The center of gravity of the seat and footrest assembly are vertically aligned with or forward of a pivot point when the seat is in the forward position, such that the seat remains in or rotates toward the forward position when unoccupied. Additionally, the seat extends in front of the armrests while the footrest remains under the seat when the seat is in the forward position, such that the seat is easy to access.

10 Claims, 1 Drawing Sheet

PIVOTING SEAT AND FOOTREST CHAIR

This application claims the benefit of U.S. Provisional application Ser. No. 60/007,422, filed Nov. 21, 1995.

TECHNICAL FIELD

This invention relates, in general to a chair that provides assisted access and exiting and, more particularly, to a chair having a seat and footrest which pivot to assist access and exiting.

BACKGROUND OF THE INVENTION

Many individuals require or prefer assistance to enter or exit a chair. Many chairs have been designed to provide this type of assistance. A typical assisting chair has a rotating seat and often a moveable footrest. There are usually a multitude of apparatus and structural elements to rotate the seat to assist the person to a seated position. These elements in various combinations include levers, pins, springs, handles, sliding elements, motors, latches, and linkages, etc. which complicate and increase the cost of these various chairs. Two prior art patents representing complex chairs are U.S. Pat. No. 4,929,022 issued to Geraci and U.S. Pat. No. 4,778,217 issued to Lane.

Additionally, a simpler apparatus is described in U.S. Pat. No. 4,059,305 issued to Ammirata. However, the Ammirata chair is difficult to use as well as unnecessarily complicated. The Ammirata seat and footrest assembly pivots about a position located at the front of the seat. As a result, the entire seat remains behind the pivot point. Since the seat remains behind the pivot point, the seat is difficult to access. The person must navigate past the armrests to reach the seat. Adding to this difficulty is the footrest which remains in front of the chair when the seat is up. The person must first step up onto the footrest before accessing the chair. In addition, the resilient straps of Ammirata add unnecessary cost and complexity to the chair.

It is the purpose of this invention to provide a simple, easy-to-use chair having a rotatable seat and footrest assembly such that as the seat rotates down from a raised position to a horizontal position, the footrest moves forward.

SUMMARY OF THE INVENTION

This invention is a chair having a frame and a rotatable seat and footrest assembly. The rotatable seat and footrest assembly is pivotally attached to the frame. The pivots are located on support members between the seat and the footrest. When the seat is in the forward position, the center of gravity is vertically aligned with or forward of the pivot point thereby allowing the seat to remain in the forward position. Consequently, no springs or positioning devices are required. Additionally, the armrests of the chair are elevated to assist in lowering the person to a seated position. Also, when the seat and footrest assembly is in the forward position, a portion of the seat is forward of the armrests and the footrest is under the seat. This configuration allows easy access to the seat.

This invention does not require external power, linkages, springs, etc. as seen in the prior art. The simplicity is obtained by locating the pivot point or fulcrum of the seat assembly such that when the seat is in the raised position, the center of gravity is either vertically aligned with or in front of the pivot point. Locating the pivot point in such a position allows the seat to remain in the raised position without additional structural elements. Additionally, easy access is provided because the seat partially rotates in front of the armrests and the footrest rotates back under the seat. Additionally, the elevated armrests which are about 12 inches above the seat make sitting down and getting out of the chair much easier since the person does not have to bend over to reach the armrests. Most other chairs have armrests that are about eight inches above the seat.

This invention is not limited to the overweight, disabled or paraplegic. It is conceived for these people as well as any healthy, normal people who want a comfortable, easy-to-use chair. The invention may be incorporated into easy chairs, couches, recliners, automobile seats or wheelchairs and orthopedic chairs. It provides an easy-to-use comfort for all people and is orthopedically correct. The seat rotates back and presses the hips to the back of the chair, consequently aligning and relaxing the spine along the backrest.

Other objects, advantages, and capabilities of the present invention will become more apparent as the description proceeds.

DETAILED DESCRIPTION OF THE INVENTION

Figure 1:
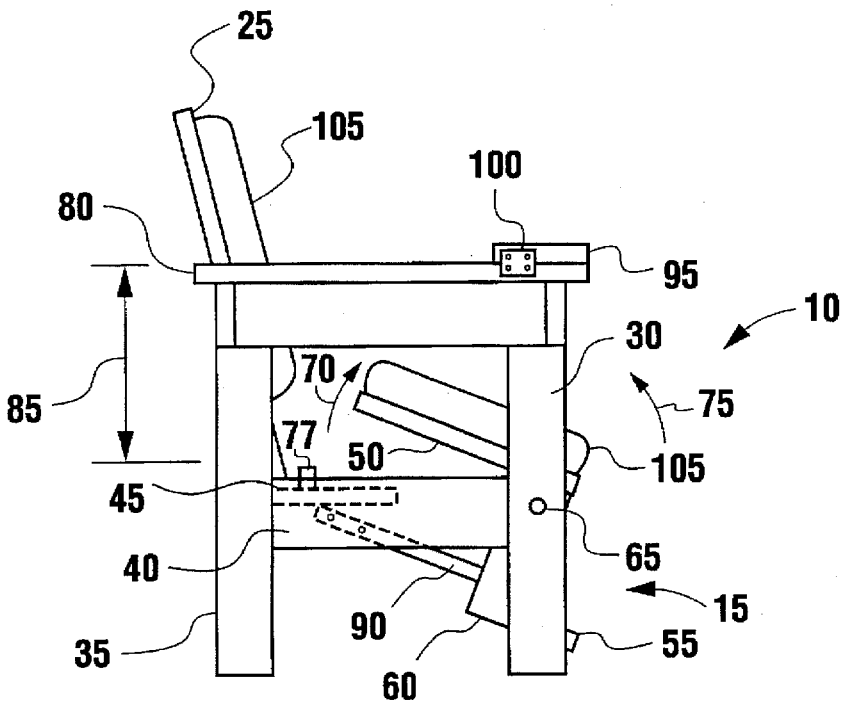
FIG. 1 is a side elevation of the chair of the present invention.
Figure 2:
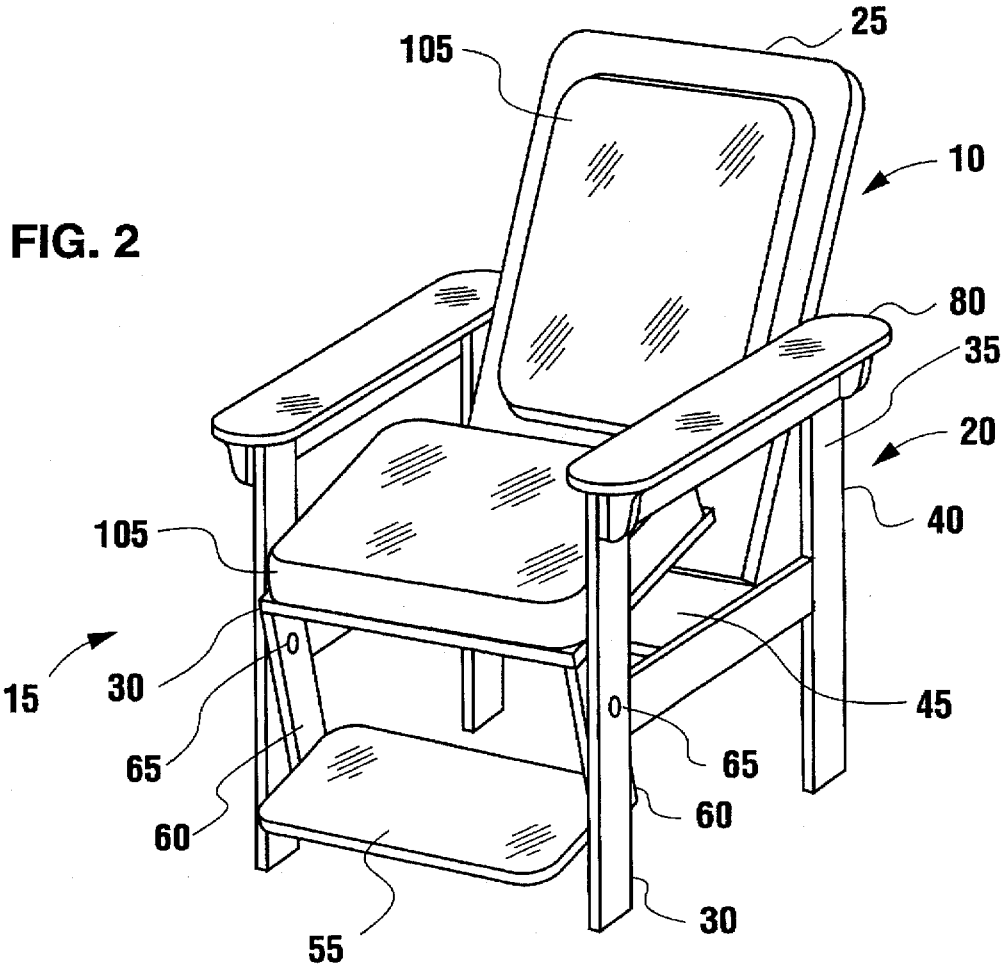
FIG. 2 is a front perspective view of the chair.

FIG. 1 and 2 illustrate a preferred embodiment of the present invention. Chair 10 includes seat assembly 15, frame 20, and backrest 25. Frame 20 includes front vertical members 30, rear vertical members 35, horizontal members 40, and seat base 45. Seat assembly 15 includes seat 50, footrest 55, and support members 60.

Support members 60 interconnect seat 50 and footrest 55. The upper portion of support members 60 preferably attach to the front portion of seat 50 at a right angle. Similarly, the lower portion of support members 60 preferably attach to the rear portion of footrest 55 at a right angle. Thus, seat 50 and footrest 55 are essentially parallel.

Support members 60 are attached to front vertical members 30 by pivots 65. Pivots 65 allow seat assembly 15 to rotate forward 70 and backward 75 with respect to frame 20. Forward motion 70 is stopped as support members 35 or footrest 55 contacts seat base 45. Similarly, backward motion 75 is stopped as seat 50 contacts adjustable bolt stop 77 at the rear of seat base 45.

Seat assembly 15 is balanced such that when seat 50 is unoccupied, seat assembly 15 will remain in or rotate to the forward position 70. Balancing chair 10 in this manner is accomplished by positioning pivots 65 so that the center of gravity of seat assembly 15 is vertically aligned with or forward of pivots 65 when seat assembly 15 is in forward position 70.

In forward position 70, seat 50 is forward and up. The front portion of seat 50 extends in from of from vertical members 30, thus providing access to seat 50 unobstructed by vertical members 30. Also in forward position 70, footrest 55 is back and under seat 50, thus allowing unobstructed access to seat 50. As a person sits on seat 50, seat assembly 15 rotates backward 75. Seat 50 moves to a down and backward position contacting adjustable bolt stop 77, while footrest 55 moves to an out and forward position.

Additionally, in a preferred embodiment, armrests 80 are provided between front vertical members 30 and rear vertical members 35 at a distance 85 of about one foot above seat 50 when seat 50 is down. Typical chairs have armrests that are positioned about 8 inches above the seat. The increased height of armrests 80 assists a person entering or exiting chair 10.

When exiting chair 10, a person Shifts forward and slightly pulls on the armrests 80. This causes seat assembly 15 to rotate forward 70, raising the person to an upright position. Simultaneously, footrest 55 rotates under seat 50 and out of the person's way. The person may then easily exit chair 10.

FIG. 1 also illustrates an optional foot push-off 90 that is affixed to horizontal seat member 40, and acts to push the person's foot off footrest 30 as footrest 55 rotates backward 75. An additional optional feature is a rotatable and hinged tray 95 shown in FIG. 1. Tray 95 swivels forward and hinge 100 allows tray 95 to fold down. Backrest 25 and seat 50 each include a comfortable cloth-covered cushion 105. The structural elements of chair 10 are made of selected sturdy materials, such as, wood, plastic, or metal.

While the present invention has been described by reference to specific embodiments, it will be apparent that other alternative embodiments and methods of implementation or modification may be employed without departing from the true spirit and scope of the invention.

What is claimed is:

1. A rotatable seat chair comprising:

(a) a chair frame having a backrest, legs, and a pair of armrests;

(b) a seat assembly comprising:

i. at least one seat support member having upper and lower portions;

ii. a seat rigidly connected at a fixed angle to the upper portion of the at least one support member; and iii. a footrest rigidly affixed to the lower portion of the at least one support member; and, (c) at least one pivot rotatably interconnecting the at least one support member and the chair frame, wherein the at least one pivot is located between the upper and lower portions of the respective support member, such that a center of gravity of the seat assembly is vertically aligned with or forward of the pivot when the seat assembly is in a forward position.

2. The chair as recited in claim 1 wherein a foot push-off is attached to the frame such that when the seat assembly is rotating toward the forward position, the push-off pushes on a person's heel thereby pushing the person's foot off the footrest.

3. The chair as recited in claim 1 wherein a hinged and swiveling tray is attached to one of the armrests.

4. The chair as recited in claim 1 wherein the distance between the armrest and seat cushion is about one foot, thereby making sitting and exiting the chair easier than conventional chairs.

5. The chair as recited in claim 1 wherein the footrest is essentially parallel to the seat.

6. A rotatable seat chair comprising:

(a) a chair frame having a backrest, legs, and a pair of armrests;

(b) a seat assembly comprising:

i. a pair of seat support members having upper and lower portions;

ii. a seat rigidly connected at a fixed angle to the upper portion of each support member; and iii. a footrest rigidly affixed to the lower portion of each support member; and, (c) a pair of pivots, each pivot rotatably interconnecting one of the pair of support members and the chair frame, wherein each pivot is located between the upper and lower portions of the respective support member, such that a center of gravity of the seat assembly is vertically aligned with or forward of the pivot when the seat assembly is in a forward position, and wherein the distance from the armrest to the sea is about one foot.

7. The chair as recited in claim 6 wherein a foot push-off is attached to the frame such that when the seat assembly is rotating toward the forward position, the push-off pushes on a person's heel thereby pushing the person's foot off the footrest.

8. The chair as recited in claim 6 wherein a hinged and swiveling tray is attached to one of the armrests.

9. The chair as recited in claim 6 wherein the footrest is essentially parallel to the seat.

10. The chair as recited in claim 6 wherein an adjustable seat stop maintains a rear seat portion at a desired elevation.

* * * * *